US010690335B2

(12) United States Patent
Xue et al.

(10) Patent No.: US 10,690,335 B2
(45) Date of Patent: Jun. 23, 2020

(54) LED LAMP

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Yuanfang Xue, Zhejiang (CN); Zhaoyong Zheng, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 16/425,200

(22) Filed: May 29, 2019

(65) Prior Publication Data

US 2019/0368720 A1 Dec. 5, 2019

(30) Foreign Application Priority Data

May 31, 2018 (CN) ..... 2018 1 0561941

(51) Int. Cl.

| | |
|---|---|
| ***F21V 31/00*** | (2006.01) |
| ***F21K 9/272*** | (2016.01) |
| ***F21K 9/69*** | (2016.01) |
| ***F21V 5/04*** | (2006.01) |
| ***F21V 23/00*** | (2015.01) |
| ***F21Y 103/10*** | (2016.01) |
| ***F21Y 115/10*** | (2016.01) |

(52) U.S. Cl.

CPC ..... *F21V 31/005* (2013.01); *F21K 9/272* (2016.08); *F21K 9/69* (2016.08); *F21V 5/04* (2013.01); *F21V 23/001* (2013.01); *F21Y 2103/10* (2016.08); *F21Y 2115/10* (2016.08)

(58) Field of Classification Search

CPC ..... F21V 31/005; F21V 5/04; F21V 23/001; F21K 9/272; F21K 9/69; F21Y 2103/10; F21Y 2115/10

See application file for complete search history.

(56) References Cited

U.S. PATENT DOCUMENTS

2014/0160731 A1* 6/2014 Ye ..... F21V 31/005 362/92
2017/0191640 A1* 7/2017 Ji ..... F21V 29/89

* cited by examiner

*Primary Examiner* — Mary Ellen Bowman
(74) *Attorney, Agent, or Firm* — Wang Law Firm, Inc.

(57) ABSTRACT

The present invention relates to an LED lamp comprising a strip housing having an inner cavity for accommodating a lamp body and at least at one end forming a opening for loading the lamp body; and a sealing end cover for sealing the opening; a sealing member is embedded in the opening, and the sealing member and the inner space of the opening have the same cross section perpendicular to the length direction of the strip housing; the sealing member and the sealing end cover are spaced apart to form a sealing cavity for injecting the sealant. the LED lamp of the invention on the one hand realizes the first waterproof protection of the end part by the sealing member, and on the other hand realizes the second waterproof protection through the sealant layer formed by pouring sealant between the sealing member and the sealing end cover, so the LED lamp has higher waterproof rating than the existing lamps and can be conveniently applied to a humid device such as refrigerator, refrigerator, freezer and vending machine.

9 Claims, 6 Drawing Sheets

LED LAMP

RELATED APPLICATION

This application claims priority to a Chinese Patent Application No. CN 201810561941.0, filed on May 31, 2018.

FIELD OF THE TECHNOLOGY

The present invention relates to lighting technology, with particular emphasis on a LED lamp.

BACKGROUND OF THE INVENTION

At present, in order to be able to provide a better view, and to facilitate users to select items and take objects, the current manufacturers of refrigerators or showcases will install corresponding lights inside the products.

In the prior art, the lighting in the refrigerator or the showcase is different from the environment in which the ordinary lamp is used, and fog and water vapor are generated due to the temperature difference. The lamp without the waterproof sealing structure is easily damaged in the freezer for a long time, and the using life of the lamp is shortened.

In addition, most of the lighting sources used in the market for refrigerators, refrigerators, freezers and vending machines use ordinary light sources, such as incandescent lamps and fluorescent lamps; such lighting sources have high energy consumption and do not have a light-sweeping function, thus resulting the lighting is inadequate or there is a shadow in the device.

BRIEF SUMMARY OF THE INVENTION

The technical problem to be solved by the present invention is to provide an LED lamp with good waterproof effect against the current state of the art.

The technical solution adopted by the present invention to solve the above problems is as follows: An LED lamp, including a strip housing having an inner cavity for accommodating a lamp body and at least at one end forming a opening for loading the lamp body; and a sealing end cover for sealing the opening; a sealing member is embedded in the opening, and the sealing member and the inner space of the opening have the same cross section perpendicular to the length direction of the strip housing; the sealing member and the sealing end cover are spaced apart to form a sealing cavity for injecting the sealant.

Advantageously, the strip housing has a base and a lens overlying the base, wherein the base integrally extruding with the lens to form an integral part. Compared with the existing split type lamp, the structure has better waterproof effect, convenient processing and lower cost, and can cooperate with the end waterproof structure to achieve a high level of waterproof effect.

Advantageously, at least one spacer support is disposed between the sealing end cover and the sealing member, and the spacer support supports and connects between the two. The spacer support enables the sealing member and the sealing end cover to conveniently form a sealing cavity 40 for injecting sealant.

Advantageously, the spacer support is integrally formed with the sealing end cover, and an axial direction of the spacer support is consistent with the length direction of the strip housing. Such a structure makes it convenient to manufacture, lower processing cost and more convenient to assemble LED lamps.

Advantageously, the sealing end cover is connected to the strip housing by screws; wherein the strip housing has an trepanning for the screw to pass through, and the sealing end cover has a fitting portion for the screw to be screwed in. This kind of fixed connection is more simple and easy to install and disassemble.

Advantageously, the fitting portion has a screw hole adapted to the screw, and the screw hole communicates with the sealing cavity, so that the sealant flows through the screw hole into the sealing cavity. When the glue is injected, the sealant can be conveniently injected from the trepanning of the strip housing, and flows through the screw hole and the diversion slot into the sealing cavity. This structural setting enables the screw hole to not only cooperate with the screw to realize the fixed connection between the strip housing and the sealing end cover, but also inject glue through the screw hole. The design is ingenious, the structure is simple, and the sealing effect after the injection is good.

Advantageously, in the precession direction of screw, the fitting portion is provided with a diversion slot, which is connecting the screw hole and the sealing cavity. This configuration facilitates machining and facilitates the flow of sealant.

Advantageously, the strip housing further has an overflow hole communicating with the sealing cavity. It is convenient to set the overflow hole to check the situation of glue injection. When the overflow hole has a sealant overflow, it indicates that the sealing cavity has been fully filled, and the glue injection can be stopped.

Advantageously, at least one end of the strip housing is provided with a wiring mechanism connected to an external power source or interconnected with adjacent lamps, and the wiring mechanism is connected to the lamp body in the strip housing through the sealing end cover and the seals; correspondingly, the sealing end cover has a first wire through hole for the wiring mechanism to pass through and adapt to the wiring mechanism, and the sealing member is provided with a second wire through hole for the wiring mechanism to pass through and adapt to the wiring mechanism; the strip housing or the sealing end cover also has a mounting portion for fixing the LED lamp to the position to be mounted.

Advantageously, the lens is a secondary light distribution lens, and the lens has a flat light incident surface and a curved light emitting surface, and the curved light emitting surface has a protruding concave cross section in the length direction of the strip housing, and the curved light emitting surface is inward concave at least in one side. The lens is designed to change the propagation path of the light through the secondary light distribution design, so that the LED lamp has a wide illumination surface and strong versatility, and has a high efficiency and uniformity of the light-sweeping function.

Advantages of the present invention compared with the prior art: the LED lamp of the present invention is provided with a sealing member at the opening, and the sealing member and the sealing end cover are spaced apart to form a sealing cavity for injecting the sealant. The LED lamp with this structure realizes the first waterproof protection of the end part by the sealing member, and on the other hand realizes the second waterproof protection through the sealant layer formed by pouring sealant between the sealing member and the sealing end cover, so the LED lamp has higher waterproof rating than the existing lamps and can be conveniently applied to a humid device such as refrigerator, refrigerator, freezer and vending machine.

BRIEF DESCRIPTION OF THE DRAWINGS

The drawings described herein are intended to promote a further understanding of the present invention, as follows.

DETAILED DESCRIPTION OF THE INVENTION

Figure 1:
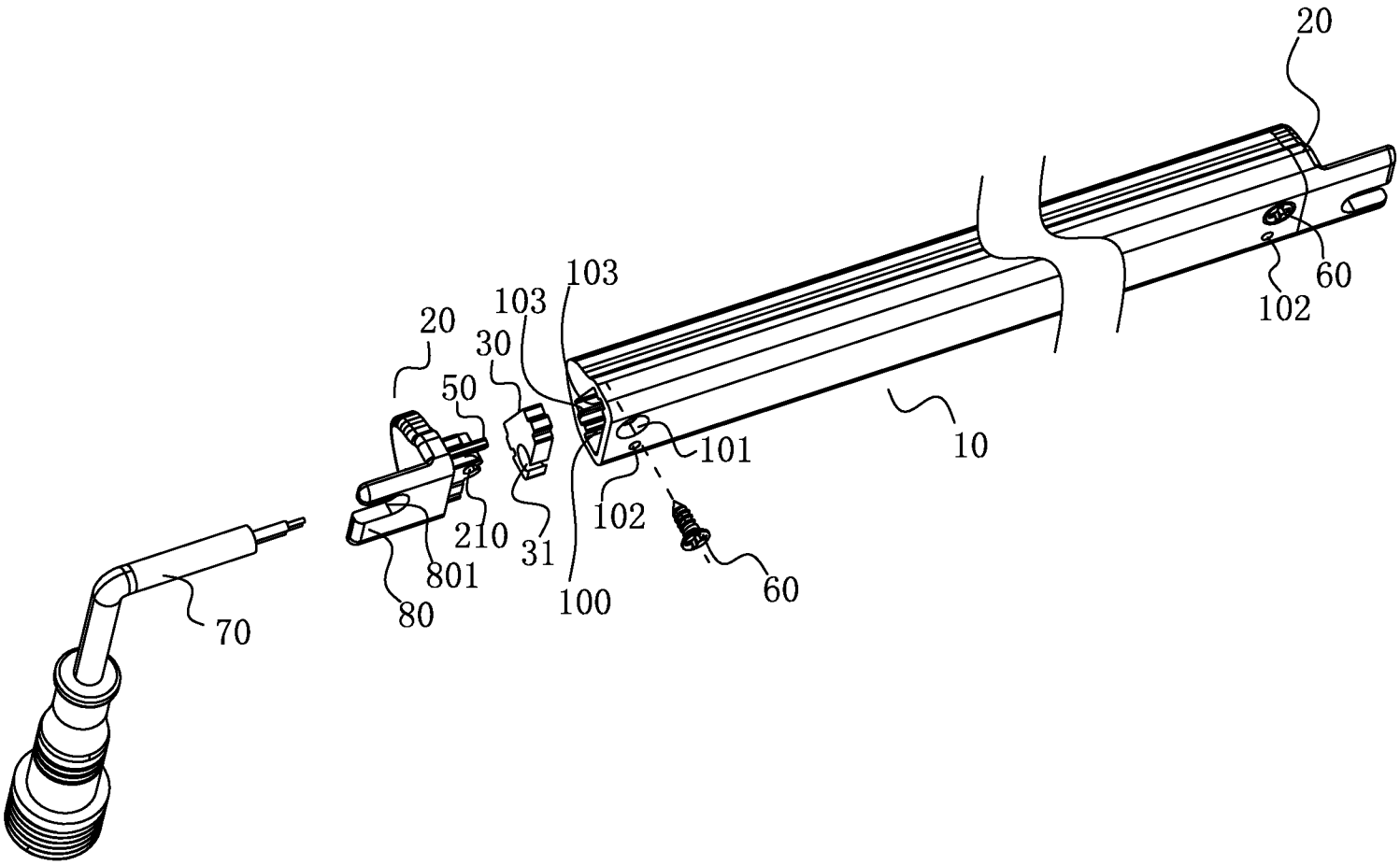
FIG. 1 is a three-dimensional structure diagram of an LED lamp according to an embodiment of the present invention, wherein a sealing end cover connecting the wiring mechanism is in an exploded state.

The present application is illustrated by way of the following detailed description based on of the accompanying drawings. It should be noted that illustration to the embodiment in this application is not intended to limit the invention.

As shown in FIG. 1 to FIG. 5, the LED lamp comprises a strip housing 10, a sealing member 30 and a sealing end cover 20, wherein the strip housing 10 has an inner cavity for accommodating the lamp body and at least one end is formed into a opening 100 for loading the lamp body, specifically, in the present embodiment, the strip housing 10 forms two openings 100 at both ends thereof, and the sealing end cover 20 is sealed at the two openings 100. A sealing member 30 is embedded in the opening 100. The sealing member 30 and the inner space of the opening 100 have the same cross section perpendicular to the length direction of the strip housing 10. It can be understood that the outer periphery of the sealing member 30 can be sealed and attached to internal face of the opening 100 to achieve a good seal, wherein the sealing member 30 can be a rubber plug with good elasticity; moreover, the sealing member 30 and the sealing end cover 20 are spaced apart to form a sealing cavity 40 for injecting the sealant. The seal glue may be a hot melt adhesive, which is in a fluid state when the temperature is high and can be poured into the sealing cavity 40 and filled with the sealing cavity 40. When the temperature is low, the sealant layer filled with the sealing cavity 40 will be formed by curing. Since the sealant is in a fluid state at the time of injection, it can fill the whole sealing cavity 40 and penetrate into the gap between sealing end cover 20, sealing member 30 and strip housing 10, achieving a high level of waterproofing. Compared with the existing lamp, the LED lamp of the invention on the one hand realizes the first waterproof protection of the end part by the sealing member 30, and on the other hand realizes the second waterproof protection through the sealant layer formed by pouring sealant between the sealing member 30 and the sealing end cover 20, so the LED lamp has higher waterproof rating than the existing lamps and can be conveniently applied to a humid device such as refrigerator, refrigerator, freezer and vending machine.

Figure 6:
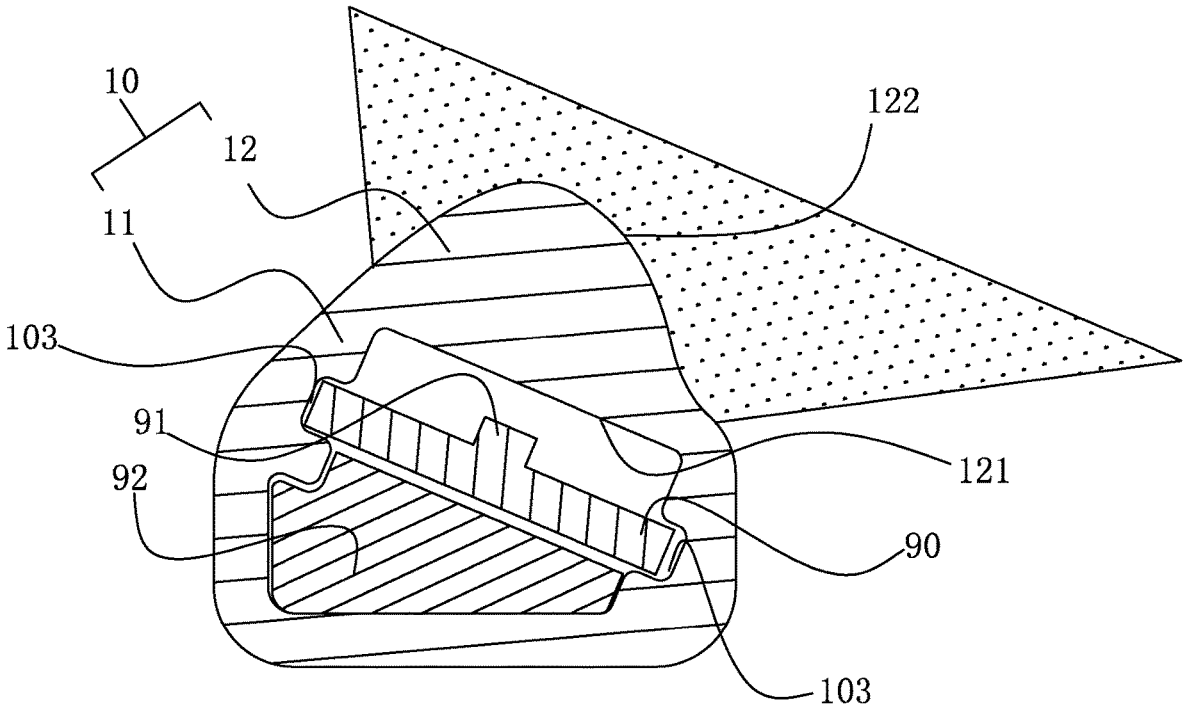
FIG. 6 is a cross-sectional view of an LED lamp in an embodiment of the present invention.

Referring to FIG. 6, in order to further improve the waterproof level and achieve a better sealing effect, in the present embodiment, the strip housing 10 has a base 11 and a lens 12 overlying the base 11, wherein the base 11 and the lens 12 are extruded together to form an integral part. Specifically, the base 11 and the lens 12 can adopt a two-color extrusion process, and the extruded profile can be customized to different lengths to meet different user requirements. More specifically, in this embodiment, the strip housing 10 is plastic two-color extrusion, and the plastic material is more convenient to process than the aluminum extrusion, and the cost is lower. Compared with the existing split type lamp, the structure has better waterproof effect, convenient processing and lower cost, and can cooperate with the end waterproof structure to achieve a high level of waterproof effect.

Continuing to refer to FIG. 6, the lens 12 of the LED lamp in this embodiment is a secondary light distribution lens 12. The lens 12 has a flat light incident surface 121 and a curved light emitting surface 122. The curved light emitting surface 122 has a protruding concave cross section in the length direction of the strip housing 10, and the curved light emitting surface 122 is recessed at least in one side, and the curved light emitting surface 122 is inward concave at least in one side, wherein the structure setting of the inwardly concave structure of the curved light emitting surface 122 is inward concave to increase the irradiation range of light. Specifically, the lamp can also adjust the illumination angle of the lamp by changing the thickness of the lens 12, the distance between the light source emission point and the lens 12, and the degree of inward concave of the curved light emitting surface 122 of the lens 12, so as to provide with a sweeping angle suitable for the space of the cabinet or the vending machine to be installed. The lens 12 is designed to change the propagation path of the light through the secondary light distribution design, so that the LED lamp has a wide illumination surface and strong versatility, and has a high efficiency and uniformity of the light-sweeping function, which can be conveniently applied in the cabinet or vending machine, the target items placed therein are illuminated, which effectively enhances the user's visual experience.

Figure 3:
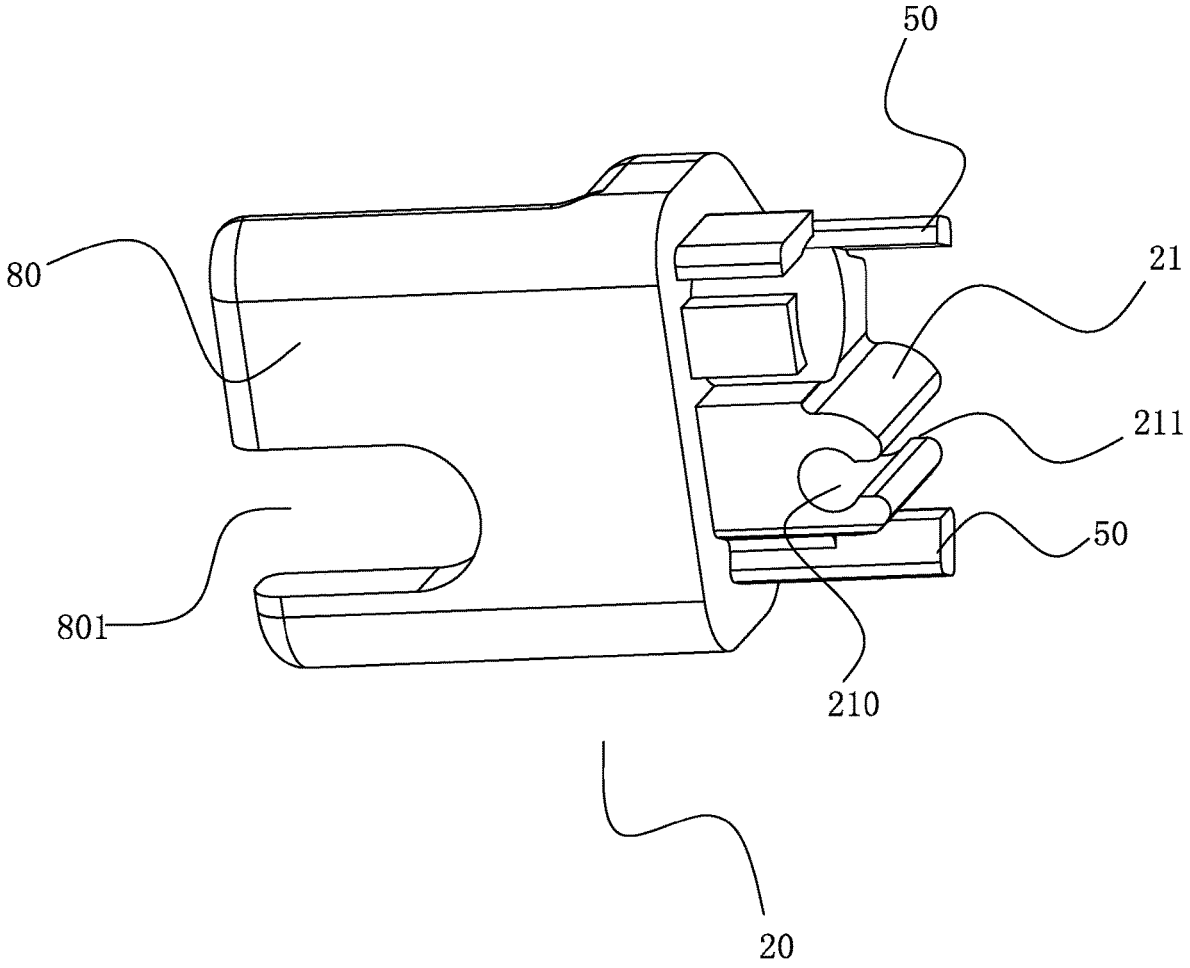
FIG. 3 is a three-dimensional structure diagram of a sealing end cover of an LED lamp in an embodiment of the present invention.
Figure 4:
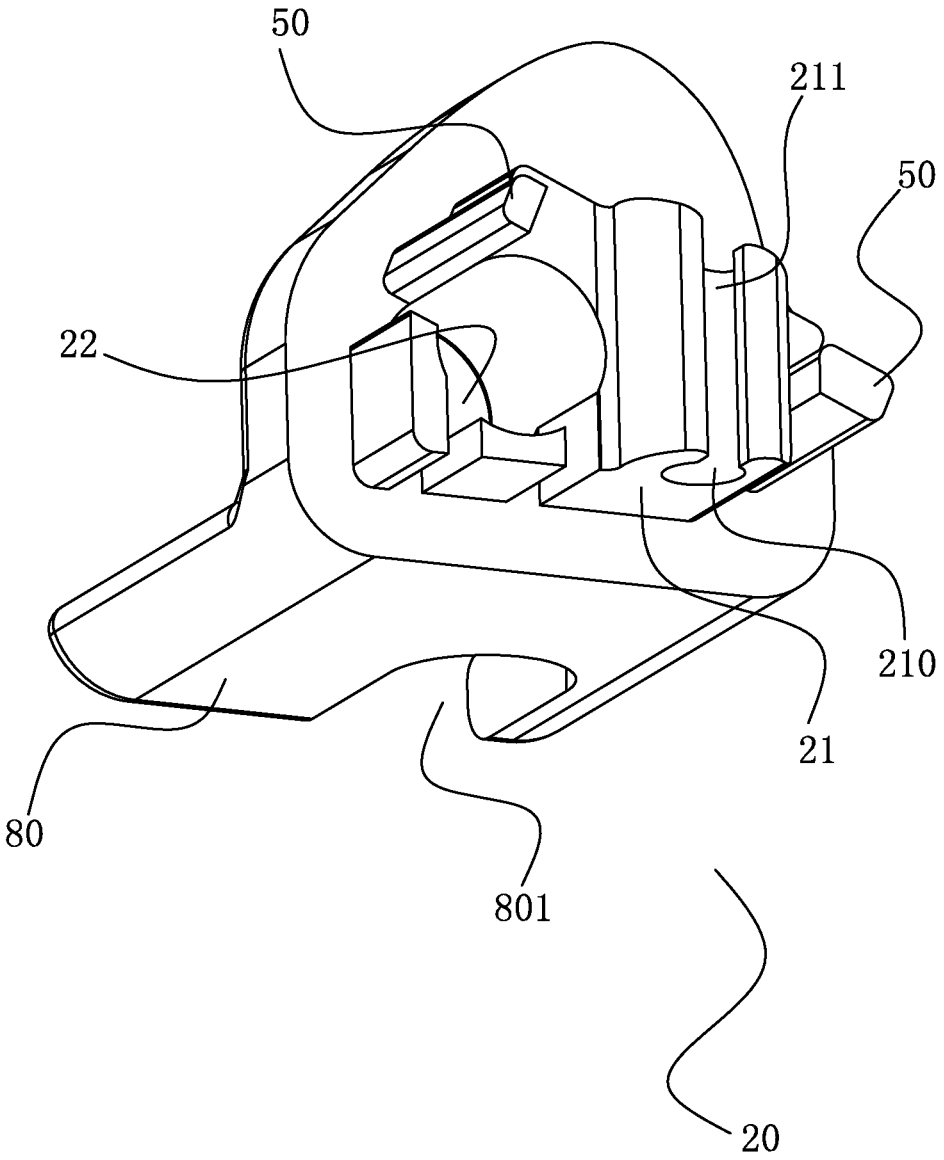
FIG. 4 is another angle three-dimensional structure diagram of a sealing end cover of an LED lamp in an embodiment of the present invention.
Figure 5:
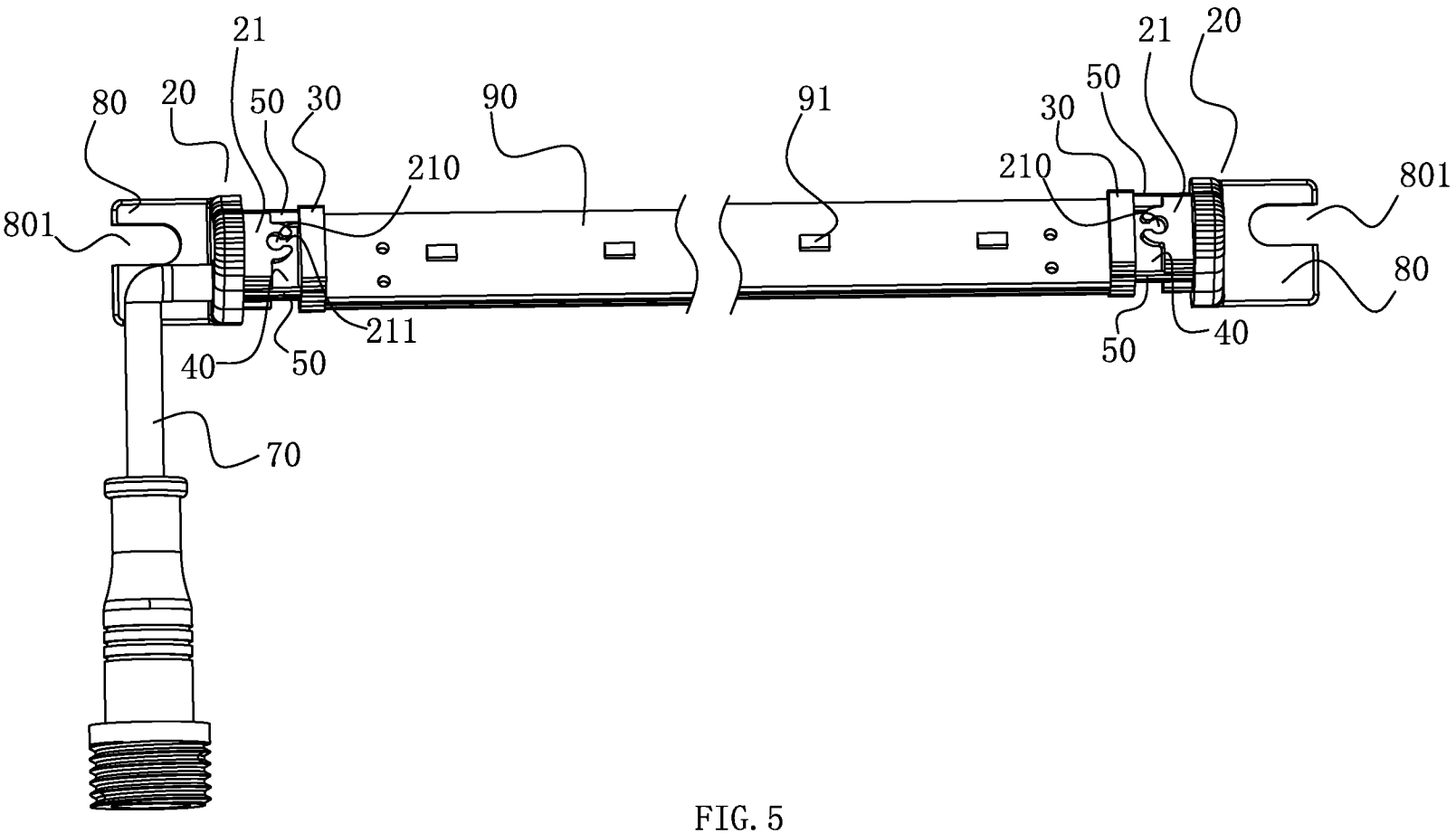
FIG. 5 is a three-dimensional structure diagram of an LED lamp in an embodiment of the present invention (a strip-shaped housing is hidden)

Referring to FIGS. 3, 4 and 5, in order to more conveniently form a sealing cavity 40 for injecting sealant between the sealing member 30 and the sealing end cover 20, and for ease of assembly, at least one spacer support 50 is arranged between the sealing end cover 20 and the sealing member 30, and the spacer support 50 supports and connects between the two. Specifically, in the embodiment, there are two spacer supports 50 on the sealing end cover 20, and the spacer support 50 is integrated with the sealing end cover 20, and the axial direction of the spacer support 50 is consistent with the length direction of the strip housing 10. Specifically, the spacer supports 50 and the sealing end cover 20 are an integral whole injection molding. It is conceivable to those skilled in the art that the spacer support 50 and the sealing end cover 20 may also be connected by other means such as welding, bonding, riveting, and the like. The spacer support 50 is disposed between the sealing member 30 and the sealing end cover 20 to fix the relative position between the two to form a stable sealing cavity 40 to improve sealing performance; On the other hand, the sealing end cover 20 is provided with two spacer supports 50. When the end part is assembled, it can make the sealing member 30 more balanced in the propulsion during embedding the opening 100 without tilting or shifting, so as to avoid a large gap between the sealing member 30 and the inner wall surface of the strip housing 10 is formed to affect the sealing effect.

Figure 2:
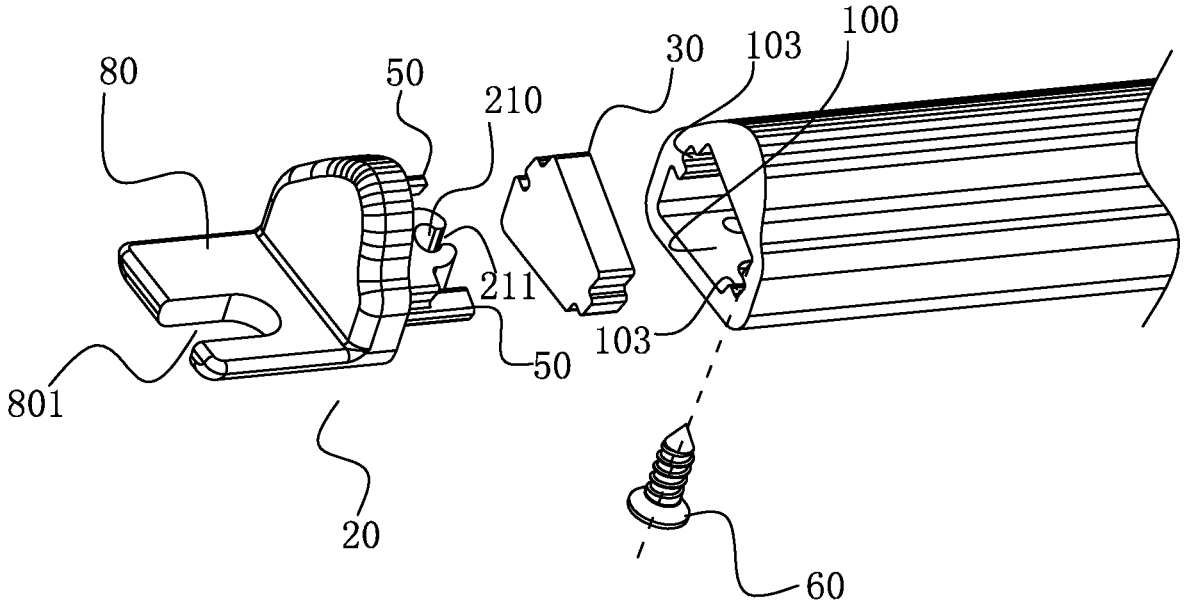
FIG. 2 is a schematic diagram of partial structure decomposition of an LED lamp in an embodiment of the present invention.

Referring to FIGS. 1 and 2, the sealing end cover 20 is connected to the strip housing 10 by screws 60, wherein the strip housing 10 has an trepanning 101 for the screw 60 to pass through and the sealing end cover 20 has a fitting portion 21 for the screw 60 to screw in. In the present embodiment, the trepanning 101 for screw 60 through is arranged on the base 11, and of course, it may be arranged on the lens 12. Specifically, the fitting portion 21 has a screw hole 210 adapted to the screw 60, wherein the screw hole 210 communicates with the sealing cavity 40, so that the sealant flows through the screw hole 210 into the sealing cavity 40. More specifically, referring to FIG. 3 and FIG. 4, In the precession direction of screw 60, the fitting portion 21 is provided with a diversion slot 211, which is connecting the screw hole 210 and the sealing cavity 40, and the diversion slot 211 is oriented toward the sealing cavity 40. The diversion slot 211 may be a strip hole in the same axial direction as the screw hole 210, or may be an arc hole provided at intervals. When the glue is injected, the sealant can be conveniently injected from the trepanning 101 of the strip housing 10, and flows through the screw hole 210 and the diversion slot 211 into the sealing cavity 40. This structural setting enables the screw hole 210 to not only cooperate with the screw 60 to realize the fixed connection between the strip housing 10 and the sealing end cover 20, but also inject glue through the screw hole 210. The design is ingenious, the structure is simple, and the sealing effect after the injection is good. In addition, in order to facilitate the view of the glue injection, the strip housing 10 also has an overflow hole 102 communicating with the sealing cavity 40. When the overflow hole 102 has a sealant overflow, it indicates that the sealing cavity 40 has been fully filled, and the glue injection can be stopped.

Referring to FIG. 1 and FIG. 4, at least one end of the strip housing 10 is provided with a wiring mechanism 70 connected to an external power source or interconnected with adjacent lamps. The wiring mechanism 70 is connected to the lamp body in the strip housing 10 through the sealing end cover 20 and the seals 30. The wiring mechanism 70 connects the lamp body in the strip housing 10 through the sealing end cover 20 and the sealing part 30, correspondingly, at this end of the strip housing 10, the sealing end cover 20 has a first wire through hole 22 for the wiring mechanism 70 to pass through and adapt to the wiring mechanism 70, and the sealing member 30 is provided with a second wire through hole 31 for the wiring mechanism 70 to pass through and adapt to the wiring mechanism 70. In this embodiment, the LED lamp has two openings 100, which are respectively a wiring end and a sealing end. The wiring end has a wiring mechanism 70, which is used to connect the external power supply. The sealing end is completely sealed by the sealing member 30 and the sealing end cover 20. Specifically, referring to FIG. 2, the sealing end cover 20 and the sealing member 30 of the sealing end are not provided with a wire through hole. In addition, in order to facilitate fixing the LED lamp to the position to be mounted, the strip housing 10 or the sealing end cover 20 further has a mounting portion 80 for fixing the LED lamp to the position to be mounted. In this embodiment, the mounting portion 80 is arranged on the sealing end cover 20 at both ends of the LED lamp. The mounting portion 80 further has the mounting hole 801. The LED lamp can be conveniently fixed at a position to be mounted through the mounting hole 801 by bolt. Specifically, the mounting portion 80 and the sealing end cover 20 are integral parts, wherein the integral parts can be integrally molded or stamped. The mounting hole 801 of the mounting portion 80 is a u-shaped hole with one side opening to facilitate the bolts to be stuck into it for fixing operation. Of course, the LED lamp can also be directly attached to the position to be installed by adhesive, or the LED lamp can be fixed in the separate mounting frame to be conveniently installed at the position to be installed, for example, the LED lamp can be fixed on the external mounting frame with screw 60 or adhesive, and then the mounting frame can be assembled in the refrigerator, vending machine and other devices by conventional mechanical connection.

Referring to FIG. 5 to FIG. 6, in the embodiment, the LED lamp further includes a lamp body disposed in the strip housing 10. The lamp body may include LED light emitting board 90 and lamp bead 91 disposed on the LED light emitting board 90, and the driving device 92 and the like. The inner wall surface of the strip housing 10 of the LED lamp further has a card slot 103 for fixing the LED light emitting board 90, and the card slot 103 is arranged along the length direction of the strip housing 10. Specifically, the card slots 103 are two, which are respectively disposed on the two sides of the LED light emitting board 90. During assembly, the LED light emitting board 90 can be conveniently inserted from a opening 100 of the LED lamp and limited within the card slot 103.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

What is claimed is:

1. An LED lamp, including, a strip housing having an inner cavity for accommodating a lamp body, at least at one end forming an opening for loading the lamp body, a trepanning, and an overflow hole;

a sealing end cover for sealing the opening, the sealing end cover having a screw hole; and a sealing member for fitting into the opening, and the sealing member and an inner space of the opening have a same cross section, wherein the sealing member and the sealing end cover are spaced apart to form a sealing cavity for injecting sealant, when the sealing cavity is full of the sealant, the sealant overflows through the overflow hole.

2. The LED lamp as claimed in claim 1 wherein the strip housing has a base and a lens overlying the base, wherein the base integrally extruding with the lens to form an integral part.

3. The LED lamp as claimed in claim 2, wherein at least one spacer support is disposed between the sealing end cover and the sealing member, and the spacer support supports and connects between the two.

4. The LED lamp as claimed in claim 3, wherein the spacer support is integrally formed with the sealing end cover, and an axial direction of the spacer support is consistent with the length direction of the strip housing.

5. The LED lamp as claimed in claim 4, wherein the sealing end cover is connected to the strip housing by screws; wherein the strip housing has an trepanning for the screw to pass through, and the sealing end cover has a fitting portion for the screw to be screwed in.

6. The LED lamp as claimed in claim 5, wherein the screw hole communicates with the sealing cavity, so that the sealant flows through the screw hole into the sealing cavity.

7. The LED lamp as claimed in claim 6, wherein in the precession direction of screw, the fitting portion is provided with a diversion slot, which is connecting the screw hole and the sealing cavity.

8. The LED lamp as claimed in claim 1, wherein at least one end of the strip housing is provided with a wiring mechanism connected to an external power source or interconnected with adjacent lamps, and the wiring mechanism is connected to the lamp body in the strip housing through the sealing end cover and the seals, the sealing end cover has a first wire through hole for the wiring mechanism to pass through, and the sealing member is provided with a second wire through hole for the wiring mechanism to pass through, the strip housing or the sealing end cover also has a mounting portion for fixing the LED lamp.

9. The LED lamp as claimed in claim 2, wherein the lens is a secondary light distribution lens, and the lens has a flat light incident surface and a curved light emitting surface, and the curved light emitting surface has a protruding concave cross section in the length direction of the strip housing, and the curved light emitting surface is inward concave at least in one side.

* * * * *